US008424499B2

(12) United States Patent
Rioli et al.

(10) Patent No.: US 8,424,499 B2
(45) Date of Patent: Apr. 23, 2013

(54) PNEUMATIC SYSTEM FOR CONTROLLING THE VALVES OF AN INTERNAL COMBUSTION ENGINE

(75) Inventors: Mauro Rioli, Sassuolo (IT); Gianluca Pivetti, Modena (IT); Joerg Ross, Modena (IT); Attilio Pietroni, Pesaro (IT)

(73) Assignee: Ferrari S.p.A. (IT)

( * ) Notice: Subject to any disclaimer, the term of this patent is extended or adjusted under 35 U.S.C. 154(b) by 369 days.

(21) Appl. No.: 12/809,978

(22) PCT Filed: Dec. 19, 2008

(86) PCT No.: PCT/IB2008/003559

§ 371 (c)(1),
(2), (4) Date: Oct. 12, 2010

(87) PCT Pub. No.: WO2009/087441

PCT Pub. Date: Jul. 16, 2009

(65) Prior Publication Data

US 2011/0030630 A1 Feb. 10, 2011

(30) Foreign Application Priority Data

Dec. 21, 2007 (IT) ..... BO07A0844

(51) Int. Cl.
*F01L 9/02* (2006.01)

(52) U.S. Cl.
USPC ..... 123/90.14; 123/90.12; 123/90.13; 123/90.65; 251/337

(58) Field of Classification Search ..... 123/90.12, 123/90.13, 90.14, 90.65; 251/337
See application file for complete search history.

(56) References Cited

U.S. PATENT DOCUMENTS 5,586,529 A 12/1996 Vallve
6,443,111 B1 * 9/2002 LaDow ..... 123/90.11
6,745,738 B1 6/2004 Bosscher

FOREIGN PATENT DOCUMENTS

| | | | |
|---|---|---|---|
| DE | 2949413 | A1 | 6/1981 |
| DE | 3808542 | A1 | 10/1988 |
| DE | 4214839 | A1 | 11/1993 |
| DE | 10207038 | A1 | 8/2003 |
| EP | 1143115 | A2 | 10/2001 |
| EP | 1143115 | B1 | 1/2004 |
| EP | 1381757 | A1 | 1/2004 |
| EP | 1381757 | B1 | 10/2004 |
| GB | 209035 | A | 7/1924 |
| WO | WO-2009087441 | A1 | 7/2009 |

OTHER PUBLICATIONS

"International Application Serial No. PCT/IB2008/003559, International Search Report of Patentability mailed May 4, 2009," 4 pgs.
"International Application Serial No. PCT/IB2008/003559, Written Opinion mailed May 4, 2009," 4 pgs.

* cited by examiner

*Primary Examiner* — Ching Chang
(74) *Attorney, Agent, or Firm* — Schwegman Lundberg & Woessner, P.A.

(57) ABSTRACT

Pneumatic system for controlling the valves of an internal combustion engine; the pneumatic system is provided with: a pneumatic accumulator containing pressurized air; a pneumatic manifold; a control device to connect the pneumatic manifold alternatively to the pneumatic accumulator with the internal combustion engine in the high rpm range and to the atmosphere with the internal combustion engine in the low rpm range; a plurality of pneumatic springs, each of which has a variable volume actuating chamber and a piston mounted slidingly inside the actuating chamber; a plurality of connecting conduits, each of which connects the actuating chamber of a respective pneumatic spring to the pneumatic manifold; and a plurality of calibrated cross-sectional portions, each of which has a reduced cross-sectional area and is arranged along a respective connecting conduit.

14 Claims, 2 Drawing Sheets

PNEUMATIC SYSTEM FOR CONTROLLING THE VALVES OF AN INTERNAL COMBUSTION ENGINE

PRIORITY CLAIM TO RELATED APPLICATION

This application is a national stage application under 35 U.S.C. §371 of PCT/IB2008/003559, filed Dec. 19, 2008, and published as WO 2009/087441 A1 on Jul. 16, 2009, which application and publication are incorporated herein by reference and made a part hereof in their entirety, and the benefit of priority of which is claimed herein.

TECHNICAL FIELD

The present subject matter relates to a pneumatic system for controlling the valves of an internal combustion engine.

BACKGROUND

In an internal combustion engine the inlet and exhaust valves are normally controlled by means of a cam system that controls the opening of the valves (i.e. to push the valves inside the respective cylinders) and mechanical springs to control the closing of the valves (i.e. to push the valves against their seats). In other words, a mechanical spring is coupled to the stem of each valve and pushes the valve towards the closed position (i.e. against its respective seat) and a cam attached to a cam shaft is mechanically coupled to cyclically push the valve towards the open position against the action of the mechanical spring.

The mechanical springs that cause the valves to close must be dimensioned so as to be able to close the valves in an interval of time that is defined by the maximum speed the engine can reach; consequently, at all other engine speeds the mechanical springs are over-sized and their cycle of compression and expansion inevitably results in a waste of energy which reduces the energy efficiency of the engine. In standard motor vehicle engines that do not reach high maximum speeds (generally not more than 5000 rpm for diesel engines and 7000 rpm for petrol engines) the mechanical valve springs use only a moderate amount of energy; however, in high-performance engines, which must necessarily reach very high speeds (of over 10,000 rpm) in order to deliver high power, the mechanical valve springs use a significant amount of energy. The use of pneumatic springs instead of the conventional mechanical springs has been proposed as a means of reducing the energy used by the valve springs. In a pneumatic spring the elastic force is generated by the compression of a fluid (typically air) rather than by the deformation of an elastic member as is the case with a mechanical spring and in a pneumatic spring it is thus possible to adjust the elastic force generated by the pneumatic spring by adjusting the pressure of the fluid inside said pneumatic spring; consequently, using pneumatic springs to control the closing of the valves makes it possible to adjust the elastic force generated by the pneumatic springs according to the engine speed and significantly reduce the amount of energy that is wasted in actuating the valves.

Patent applications GB209035 and FR2364328 describe a valve of an internal combustion engine provided with a return device comprising a pneumatic spring and a mechanical coil spring.

Patent application DE3808542A1 describes a valve of an internal combustion engine provided with a return device comprising a pneumatic spring and a mechanical coil spring, which is dimensioned to develop a limited elastic force suitable for a moderate engine speed (low number of rpm). In the low rpm range, a chamber of the pneumatic spring is connected to the atmosphere and the return force of the valve is generated exclusively by the mechanical coil spring; in the high rpm range, the chamber of the pneumatic spring is connected by means of a pressure regulator to a pneumatic accumulator containing compressed air and the return force of the valve is generated by both the mechanical coil spring, and, primarily, by the pneumatic spring.

Patent application DE4214839A1 describes a valve of an internal combustion engine provided with a return device comprising a pneumatic spring and a mechanical coil spring, which develops a limited elastic force and has the safety function of guaranteeing engine operation at minimum speed even in the event of a pneumatic spring failure. The chamber of the pneumatic spring is maintained under pressure by means of a pressurized tank that is constantly connected to said chamber by means of a feed conduit having a reduced cross-sectional area.

Patent EP1381757B1 describes a valve of an internal combustion engine provided with a return device comprising a pneumatic spring and a mechanical coil spring, which produces a limited elastic force and has the purpose of enabling the engine to run at minimum speed even in the event of a pneumatic spring failure.

Patent application EP1143115B1 describes a valve of an internal combustion engine provided with a return device comprising a pneumatic spring and a mechanical coil spring, which produces a limited elastic force suited to a low engine speed (low rpm range). In the low rpm range, a chamber of the pneumatic spring is connected to the atmosphere via a first box-type solenoid valve and the return force of the valve is generated exclusively by the mechanical coil spring; in the high rpm range, the chamber of the pneumatic spring is connected to a pressure source via a second box-type solenoid valve and the return force of the valve is generated by both the mechanical coil spring, and, primarily, by the pneumatic spring.

The pneumatic valve control systems described above are complex to produce and offer limited reliability.

SUMMARY

Examples disclosed here provide a pneumatic system for controlling the valves of an internal combustion engine, said pneumatic system overcoming the drawbacks described above and, at the same time, being easy and inexpensive to produce.

According to some examples a pneumatic system for controlling the valves of an internal combustion engine is produced according to that claimed in the appended claims.

BRIEF DESCRIPTION OF THE DRAWINGS

Aspects of the present invention will now be described with reference to the accompanying drawings, illustrating a non-limiting embodiment thereof, in which.

DETAILED DESCRIPTION

Figure 1:
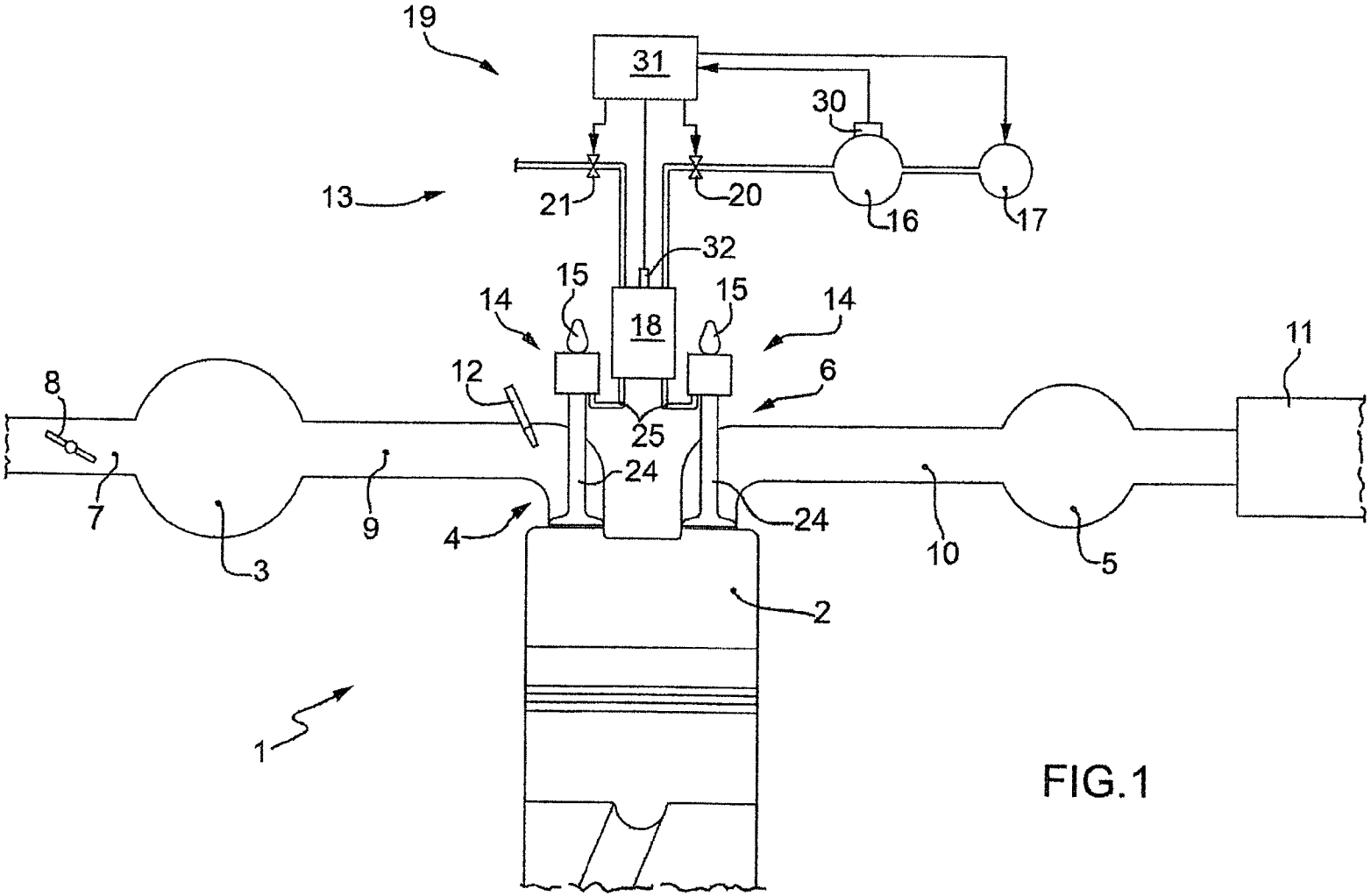
FIG. 1 is a schematic view of an internal combustion engine provided with a pneumatic system for controlling the valves according to some examples.

In FIG. 1 designated as a whole by number 1 is an internal combustion engine provided with a plurality of cylinders 2

(only one of which is illustrated in FIG. 1), each of which is connected to an intake manifold 3 by means of at least one inlet valve 4 and to an exhaust manifold 5 by means of at least one exhaust valve 6.

The intake manifold 3 receives fresh air (i.e. air from the outside) through a feed conduit 7 controlled by a throttle valve 8 and is connected to the cylinders 2 by means of respective intake ducts 9 (only one of which is illustrated in FIG. 1), each of which is controlled by the relative inlet valve 4. Likewise, the exhaust manifold 5 is connected to the cylinders 2 by means of respective exhaust ducts 10 (only one of which is illustrated in FIG. 1), each of which is controlled by the relative exhaust valve 6. An emission conduit 11 leads from the exhaust manifold 5 and terminates in a muffler (of a type that is known and which is not illustrated here) to discharge the exhaust gases into the atmosphere.

According to the embodiment illustrated in the figure, the fuel is injected into each intake duct 9 via an injector 12 arranged close to the inlet valve 4. According to an alternative embodiment that is not illustrated, the injectors 12 are arranged so as to inject the fuel directly into the cylinders 2.

The internal combustion engine 1 also comprises a pneumatic system 13 for controlling the valves 4 and 6. In particular, for each valve 4 or 6 the pneumatic system 13 comprises a pneumatic spring 14 that tends to maintain the valve 4 or 6 in a closed position and a cam 15 that is operated by a drive shaft via a mechanical transmission and cyclically pushes the valve 4 or 6 from the closed position to the open position against the elastic force of the pneumatic spring 14.

The pneumatic system 13 comprises a pneumatic accumulator 16 containing pressurized air (as a rough guide the nominal value of the pressure inside the pneumatic accumulator 16 is approximately 5 bar), a compressor 17 (operated by a drive shaft of the internal combustion engine 1 or by an electric motor of its own) to maintain the pneumatic accumulator 16 under pressure, a pneumatic manifold 18 arranged close to (or inside) a cylinder-head of the internal combustion engine 1, and a control device 19 to connect the pneumatic manifold 18 alternatively to the pneumatic accumulator 16 in the high rpm range of the internal combustion engine 1 and to the atmosphere in the low rpm range of the internal combustion engine 1. According to the embodiment illustrated in FIG. 1, the control device 19 comprises a solenoid valve 20 to connect the pneumatic manifold 18 to the pneumatic accumulator 16 and a solenoid valve 21 to connect the pneumatic manifold 18 to the atmosphere.

Figure 2:
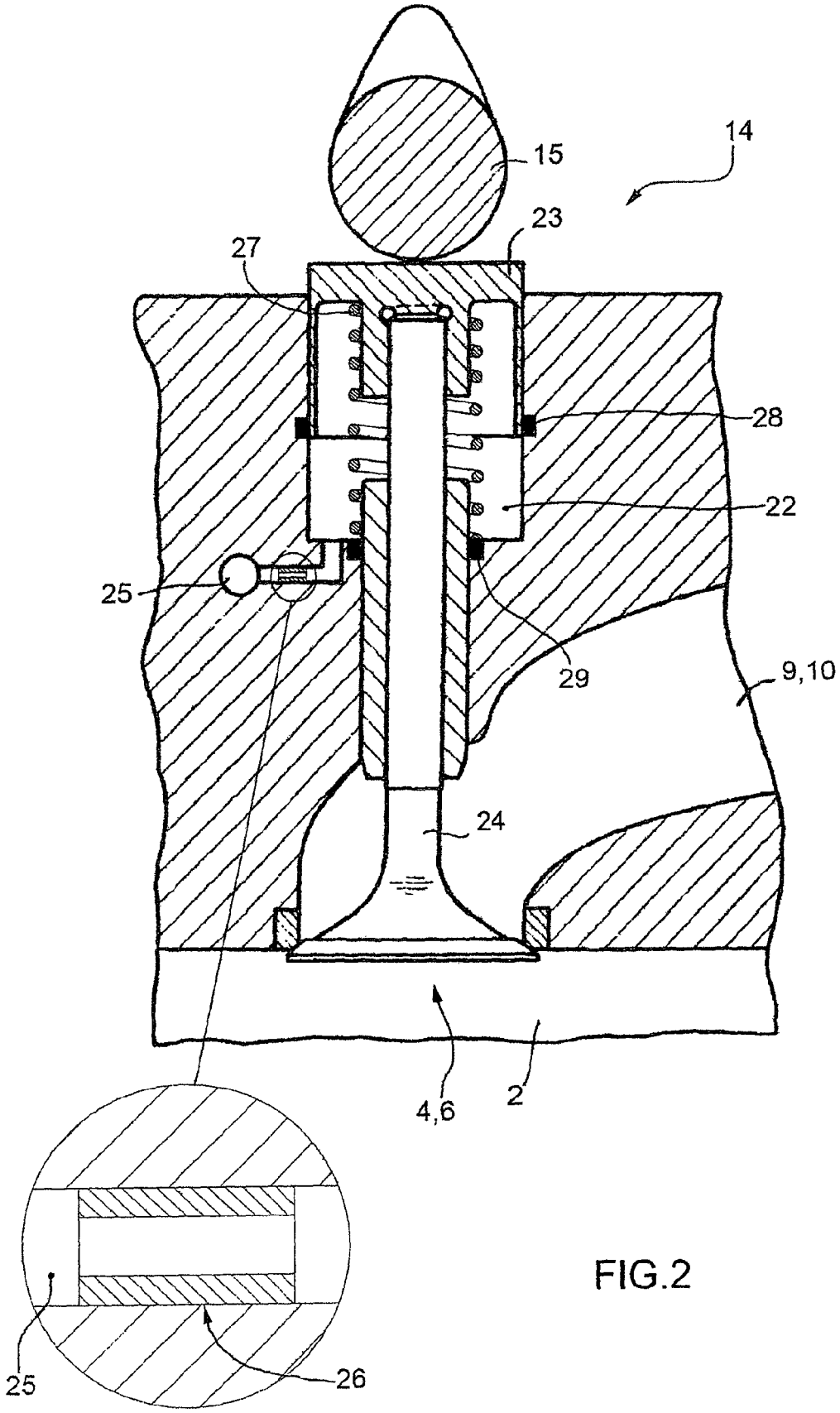
FIG. 2 is a schematic, cross-sectional view of a valve of the internal combustion engine of FIG. 1.

According to the illustration in FIG. 2, each pneumatic spring 14 comprises a variable volume actuating chamber 22 obtained inside a cylinder-head of the internal combustion engine 1 and a piston 23 mounted slidingly inside the actuating chamber 22 and integral with a stem 24 of a respective valve 4 or 6; in the closed position of the valve 4 or 6 the volume of the actuating chamber 22 is at the maximum level and to open the valve 4 or 6 the volume of the actuating chamber 22 must be reduced, i.e. the air inside the actuating chamber 22 must be compressed.

Each actuating chamber 22 is permanently connected to the pneumatic manifold 18 via a connecting conduit 25 having a calibrated cross-sectional portion 26 with a reduced cross-sectional area (as a rough guide the inside diameter of the calibrated cross-sectional portion 26 is between 0.2 and 0.5 mm).

The cross-sectional area of each calibrated cross-sectional portion 26 is dimensioned in order that the maximum air flow rate through the calibrated cross-sectional portion 26 is low with respect to the ratio between the volume of the actuating chamber 22 and the opening time of a valve 4 or 6; as a rough guide, the maximum air flow rate through the calibrated cross-sectional portion 26 is less than 10% of the ratio between the volume of the actuating chamber 22 and the opening time of a valve 4 or 6.

Given the presence of the calibrated cross-sectional portion 26, during the opening of each valve 4 or 6 significant amounts of the air inside the actuating chamber 22 of the respective pneumatic spring 14 are not able to leak out of said actuating chamber 22 even if the actuating chamber 22 is permanently connected to the pneumatic manifold 18 via the connecting conduit 25. In other words, if the maximum air flow rate through the calibrated cross-sectional portion 26 is less than 10% of the ratio between the volume of the actuating chamber 22 and the opening time of a valve 4 or 6, then during the opening of each valve 4 or 6 the amount of air present inside the actuating chamber 22 of the respective pneumatic spring 14 cannot fall by more than 10%.

According to a some examples, the pneumatic system 13 comprises a plurality of mechanical coil springs 27, each of which is arranged inside the actuating chamber 22 of a respective pneumatic spring 14 and is compressed by the displacement of the piston 23 to open the respective valve 4 or 6. The function of the mechanical springs 27 is essentially to enable the emergency operation of the internal combustion engine 1 in the event of failure of the pneumatic system 13; consequently, the mechanical springs 27 are dimensioned so as to only be able to close the valves 4 or 6 in the low rpm range (for example at less than 2500 rpm). Thus, in the event of a failure of the pneumatic system 13 a "recovery" condition is activated, in which the maximum speed of the internal combustion engine 1 is greatly limited to prevent the mechanical springs 27 from leaving the field of operation (i.e. to prevent the mechanical springs 27 from exceeding their dynamic limits).

In each pneumatic spring 14 the actuating chamber 22 is provided with a pneumatic seal 28 arranged between the actuating chamber 22 and the piston 23 and a pneumatic seal 29 arranged between the actuating chamber 22 and the stem 24 that passes through said actuating chamber 22. According to some examples, the pneumatic seals 28 and/or 29 of the actuating chamber 22 are purposely arranged so as not to provide a perfect seal so that a certain amount of air always passes through to the outside of the actuating chamber 22; the purpose of this passage of air towards the outside of the actuating chamber 22 is to allow any lubricating oil that has accidentally penetrated into the actuating chamber 22 to be expelled from said actuating chamber 22. In this way there is no need to provide the pneumatic manifold 18 or the pneumatic accumulator 16 with a circuit to recover and re-circulate the lubricating oil that accidentally penetrates into the actuating chambers 22 of the pneumatic springs 14.

In some instances, the volume of the pneumatic accumulator 16 is much greater than the total volume of the pneumatic manifold 18 and of the actuating chambers 22 of the pneumatic springs 14; it is therefore possible to limit the intensity of fluctuations in the air pressure in the pneumatic accumulator 16 during the operation of the internal combustion engine 1.

According to that illustrated in FIG. 1, the pneumatic accumulator 16 is provided with a pressure sensor 30, which measures the value of the pressure inside the pneumatic accumulator 16 which is used as feedback by a control unit 31 for controlling the compressor 17. The pneumatic manifold 18 may also be provided with a pressure sensor 32, to measure the value of the pressure in the pneumatic manifold 18 and is connected to the control unit 31; the function of the pressure sensor 32 is to check the value of the air pressure in the pneumatic manifold 18 so that any faults can be diagnosed in good time and thus to limit the maximum speed of the internal combustion engine 1.

In use, the control unit 31 controls the solenoid valves 20 and 21 of the control device 19 to connect the pneumatic manifold 18 alternatively to the pneumatic accumulator 16 with the internal combustion engine 1 in the high rpm range (as a rough guide, more than 4000-5000 rpm) and to the atmosphere with the internal combustion engine 1 in the low rpm range. In both conditions, each pneumatic spring 14 generates an elastic force of pneumatic origin that opposes the opening of the respective valve 4 or 6 and returns said respective valve 4 or 6 to the closed position when the thrust of the respective cam 15 is interrupted. The only difference between the two conditions (pneumatic manifold 18 connected to the pneumatic accumulator 16 or pneumatic manifold 18 connected to the atmosphere) is the initial pressure in the actuating chamber 22 of each pneumatic spring 14 which is the equivalent of 1 bar (atmospheric pressure) when the pneumatic manifold 18 is connected to the atmosphere and the equivalent of 5 bar when the pneumatic manifold 18 is connected to the pneumatic accumulator 16; clearly, the higher the initial pressure in the actuating chamber 22 of a pneumatic spring 14, the greater the elastic force generated by said pneumatic spring 14. Clearly the elastic force of pneumatic origin generated by each pneumatic spring 14 is always added to the elastic force of mechanical origin generated by the corresponding mechanical spring 27.

In other words, at low speeds the pneumatic manifold 18 is disconnected from the pneumatic accumulator 16 and is connected to the atmosphere; in this condition the pneumatic thrust generated by the pneumatic springs 14 is still present albeit at a lower value. At high speeds, the pneumatic manifold 18 is connected to the pneumatic accumulator 16 and is disconnected from the atmosphere; in this condition the pneumatic thrust generated by the pneumatic springs 14 is greater due to the overpressure in the pneumatic accumulator 16.

As stated previously, the cross-sectional area of each calibrated cross-sectional portion 26 is dimensioned in order that the maximum air flow rate through the calibrated cross-sectional portion 26 is low with respect to the ratio between the volume of the actuating chamber 22 and the opening time of a valve 4 or 6; thus, during the opening of each valve 4 or 6 significant amounts of the air inside the actuating chamber 22 of the respective pneumatic spring 14 are not able to leak out of said actuating chamber 22 even though the actuating chamber 22 is permanently connected to the pneumatic manifold 18 via the connecting conduit 25. When a cam 15 pushes a stem 24 to open the respective valve 4 or 6, the piston 23 of the respective pneumatic spring 14 is displaced and reduces the volume of the actuating chamber 22 thus causing the air inside said actuating chamber 22 to be compressed; following said compression, the air inside the actuating chamber 22 leaks through the connecting conduit 25, but such leak occurs slowly i.e. it is limited due to the calibrated cross-sectional portion 26. Thus said compression generates a pneumatic thrust on the piston 23 which pushes to expand the actuating chamber 22, i.e. to move the valve 4 or 6 into the original closed position; clearly, this pneumatic thrust is always added to the mechanical thrust generated by the mechanical spring 27.

It is important to note that when a piston 23 expands the volume of the relative actuating chamber 22, i.e. when the stem 24 of a valve 4 or 6 moves towards the closed position, a depression is created inside the actuating chamber 22 that draws air from the pneumatic manifold 18 into said actuating chamber 22; said supply of air from the pneumatic manifold 18 into the actuating chamber 22 occurs slowly in that it is limited by the calibrated cross-sectional portion 26 of the connecting conduit 25. In other words, during an opening and closing cycle of a valve 4 or 6 the actuating chamber 22 of the relative pneumatic spring 14 "breathes", i.e. it expels the air (slowly) during the opening of the valve 4 or 6 and then draws air in (slowly) during the closing of the valve 4 or 6; at the end of an opening and closing cycle of a valve 4 or 6 the actuating chamber 22 of the respective pneumatic spring 14 is in the same condition that it was in at the beginning of the opening and closing cycle of the valve 4 or 6 (i.e. with the same amount of air inside the chamber and thus with the same air pressure that is substantially the same as the air pressure in the pneumatic manifold 18).

The pneumatic system 13 described above has numerous advantages, in that it is simple and inexpensive to produce and above all is extremely reliable. Thanks to the presence of the calibrated cross-sectional portions 26, even in the event of a sudden fault in the control device 19 that leads to a sudden drop in the air pressure inside the pneumatic manifold 18, the pressure in the actuating chambers 22 of the pneumatic springs 14 falls slowly enabling the control unit 31 to reduce the speed of the internal combustion engine 1 without any problems, i.e. without preventing the valves 4 or 6 from closing in time.

The invention claimed is:

1. A pneumatic system for controlling the valves of an internal combustion engine; the pneumatic system comprising:

a pneumatic accumulator containing pressurized air;

a compressor to maintain the pneumatic accumulator under pressure;

a pneumatic manifold;

a control device to connect the pneumatic manifold alternatively to the pneumatic accumulator with the internal combustion engine in the high rpm range and to the atmosphere with the internal combustion engine in the low rpm range;

a plurality of pneumatic springs, each of which comprises a variable volume actuating chamber and a piston mounted slidingly inside the actuating chamber and mechanically coupled to a stem of a respective valve of the internal combustion engine; and a plurality of connecting conduits, each of which connects the actuating chamber of a respective pneumatic spring to the pneumatic manifold;

wherein the pneumatic system comprises a plurality of calibrated cross-sectional portions, each of which has a reduced cross-sectional area and is arranged along a respective connecting conduit.

2. The pneumatic system according to claim 1, wherein the control device comprises a first solenoid valve to connect the pneumatic manifold to the pneumatic accumulator and a second solenoid valve to connect the pneumatic manifold to the atmosphere.

3. The pneumatic system according to claim 1, wherein the inside diameter of each calibrated cross-sectional portion is between 0.2 and 0.5 mm.

4. The pneumatic system according to claim 1, wherein the cross-sectional area of each calibrated cross-sectional portion is dimensioned in order that the maximum air flow rate through the calibrated cross-sectional portion is low with respect to the ratio between the volume of the actuating chamber and the opening time of a valve (4, 6) of the internal combustion engine.

5. The pneumatic system according to claim 4, wherein the cross-sectional area of each calibrated cross-sectional portion is dimensioned so that the maximum air flow rate through the calibrated cross-sectional portion is less than 10% of the ratio between the volume of the actuating chamber and the opening time of a valve (4, 6) of the internal combustion engine.

6. The pneumatic system according to claim 1 and comprising a plurality of mechanical springs, each of which is arranged inside the actuating chamber of a respective pneumatic spring and is compressed by the displacement of the piston.

7. The pneumatic system according to claim 1, wherein in each pneumatic spring the actuating chamber is provided with a first pneumatic seal arranged between the actuating chamber and the piston.

8. The pneumatic system according to claim 7, wherein in each pneumatic spring the stem of the respective valve (4, 6) of the internal combustion engine passes through the actuating chamber which is provided with a second pneumatic seal arranged between the actuating chamber and the stem.

9. The pneumatic system, according to claim 7, wherein in each pneumatic spring the pneumatic seals of the actuating chamber are purposely arranged so as not to provide a perfect seal so that a certain amount of air always passes through to the outside of the actuating chamber.

10. The pneumatic system according to claim 1, wherein the volume of the pneumatic accumulator is much greater than the total volume of the pneumatic manifold and of the actuating chambers of the pneumatic springs.

11. The pneumatic system according to claim 1, wherein the pneumatic accumulator is provided with a first pressure sensor, which measures the value of the pressure inside the pneumatic accumulator that is used as feedback for controlling the compressor.

12. The pneumatic system according to claim 1, wherein the pneumatic manifold is provided with a second pressure sensor, which measures the value of the pressure inside the pneumatic manifold.

13. The pneumatic system according to claim 1, wherein the nominal value of the pressure inside the pneumatic accumulator is equivalent to approximately 5 bar.

14. The pneumatic system according to claim 1, wherein the pneumatic manifold is connected to the pneumatic accumulator when the speed of the engine is more than 4000-5000 rpm.

* * * * *

UNITED STATES PATENT AND TRADEMARK OFFICE

CERTIFICATE OF CORRECTION

PATENT NO. : 8,424,499 B2
APPLICATION NO. : 12/809978
DATED : April 23, 2013
INVENTOR(S) : Rioli et al.

It is certified that error appears in the above-identified patent and that said Letters Patent is hereby corrected as shown below:

On the title page, in column 1, under "(86) PCT No.", line 3, delete "Oct. 12, 2010" and insert --Oct. 21, 2010--, therefor Signed and Sealed this
Fourth Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,424,499 B2
APPLICATION NO. : 12/809978
DATED : April 23, 2013
INVENTOR(S) : Rioli et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 491 days.

Signed and Sealed this
Eighth Day of September, 2015

Michelle K. Lee

Michelle K. Lee
*Director of the United States Patent and Trademark Office*